US008774682B2

(12) United States Patent
Bhattacharyya

(10) Patent No.: US 8,774,682 B2
(45) Date of Patent: Jul. 8, 2014

(54) METHOD FOR MEASURING CONDUCTIVITY OF INK

(75) Inventor: Manoj K Bhattacharyya, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 494 days.

(21) Appl. No.: 12/995,435

(22) PCT Filed: May 30, 2008

(86) PCT No.: PCT/US2008/065385

§ 371 (c)(1), (2), (4) Date: Jan. 12, 2011

(87) PCT Pub. No.: WO2009/145788

PCT Pub. Date: Dec. 3, 2009

(65) Prior Publication Data

US 2011/0102003 A1 May 5, 2011

(51) Int. Cl.
*G03G 15/10* (2006.01)

(52) U.S. Cl.
USPC ..... 399/237; 399/57

(58) Field of Classification Search
USPC ..... 399/237, 57, 240, 241, 249; 73/53.01; 324/71.1
See application file for complete search history.

(56) References Cited

U.S. PATENT DOCUMENTS

| | | | | |
|---|---|---|---|---|
| 6,141,510 | A | 10/2000 | Yamamoto | |
| 6,416,175 | B2 | 7/2002 | Furukawa | |
| 7,334,882 | B2 | 2/2008 | Nakazawa | |
| 7,792,444 | B2 * | 9/2010 | Raz et al. | 399/57 |

FOREIGN PATENT DOCUMENTS

| | | |
|---|---|---|
| EP | 1349017 A2 | 10/2003 |
| EP | 1679556 A1 | 7/2006 |
| JP | 11-065297 | 3/1999 |

OTHER PUBLICATIONS

Extended European search report in counterpart EP patent application 08769915.3, dated Feb. 29, 2012.

* cited by examiner

*Primary Examiner* — Sophia S Chen

(57) ABSTRACT

Methods and devices for measuring conductivity of ink in a printing system are disclosed. An embodiment of the method is used with a printing system having a developer roller, wherein the ink is formed on the developer roller using electrostatic forces and is used to print on a substrate. A first current charges the developer roller during the printing. The first current is measured and the conductivity of the ink is determined, wherein the conductivity is proportional to the square of the first current.

15 Claims, 2 Drawing Sheets

METHOD FOR MEASURING CONDUCTIVITY OF INK

BACKGROUND

In printing systems, the conductivity, such as the high field conductivity, of liquid ink is required to be known in order to maintain high print quality. High field conductivity is inferred, in the existing systems, from low field conductivity, which can be measured. Newer inks have no appreciable low field conductivity. Accordingly, their low field conductivity cannot be measured. It follows that their high field conductivity cannot be inferred. Therefore, a need exists for a method or device to measure high field conductivity of the ink.

DETAILED DESCRIPTION

Figure 1:
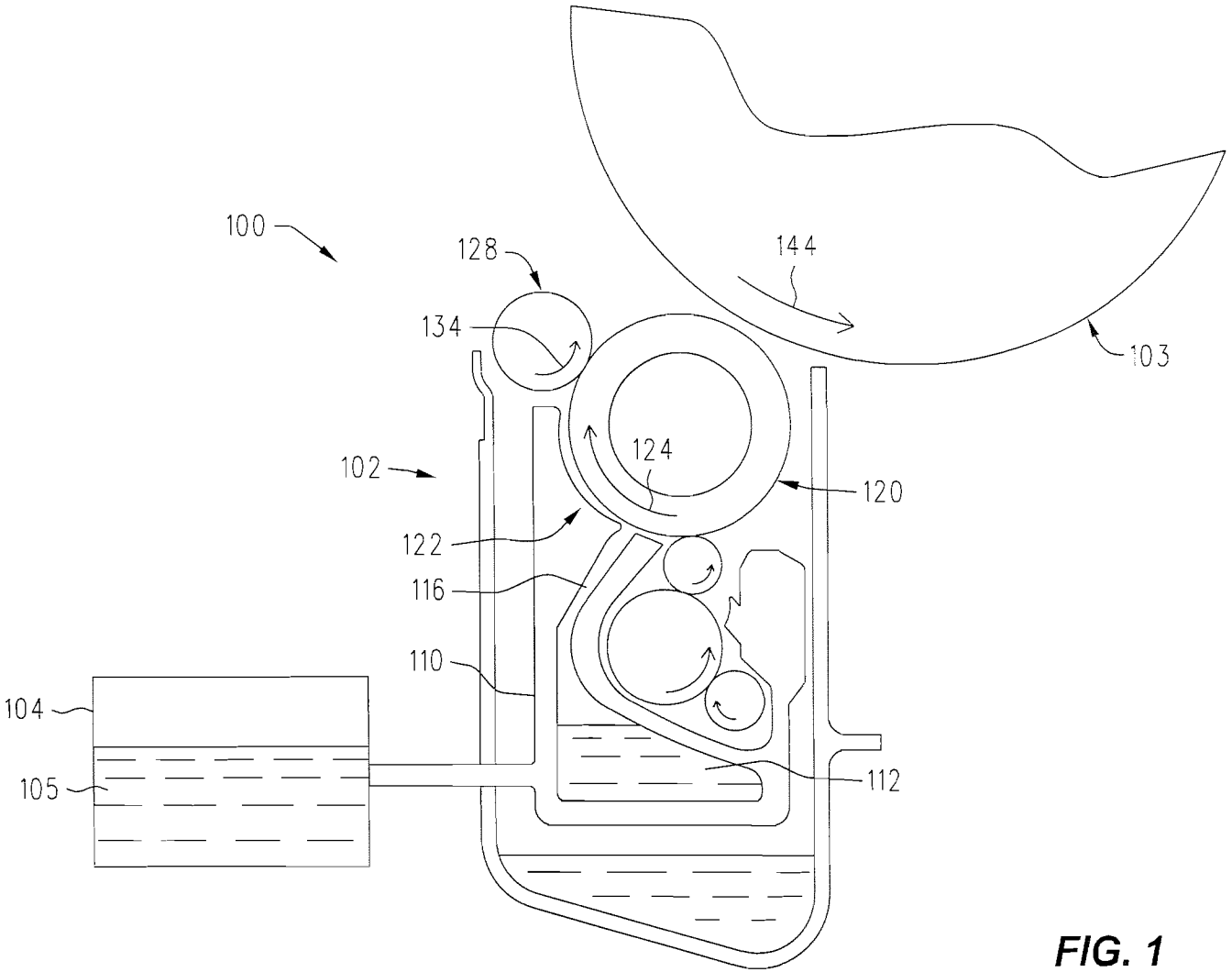
FIG. 1 is a partial cut-away view of an embodiment of a binary ink developer of a printing system.

A partial, side cut away view of an embodiment of a portion of a printing system 100 is shown in FIG. 1. The printing system 100 described in FIG. 1 is an electrophotographic printing system. The printing system of FIG. 1 includes a binary ink developer 102 that is associated with a photo imaging plate 103. The photo imaging plate is sometimes referred to as a photo conductor member or element. It is noted that the photo imaging plate 103 may be associated with a plurality of binary ink developers. All of the binary ink developers are similar to the binary ink developer 102. Each of the binary ink developers may process a different color of ink in order to generate a color image.

A tank 104 is connected to the binary ink developer 102, wherein ink 105 in the tank 104 may be transported to the binary ink developer 102 as described in greater detail below. The ink 105 in the tank 104 is electrically neutral. As described in greater detail below, the ink 105 contains particles that may be charged so as to charge the ink 105 in a conventional manner during the printing process. The solid density of the ink 105 in the tank 104 is able to be measured via conventional techniques.

Methods of measuring the conductivity of the ink 112 are described herein. Knowing the conductivity of the ink 112 enables the binary ink developer 102 and/or the printing system 100 to adjust the printing to obtain the best quality print. It is noted that the conductivity of the ink 105 is measured.

The binary ink developer 102 may have a reservoir 110 that stores ink 112. The ink 112 may be pumped to the reservoir 110 from the tank 104. A channel 116 extending from the reservoir 110 enables the ink 112 to flow to a developer roller 120. Ink from the developer roller 120 transfers to a photo imaging plate 103 by way of electrostatic forces. The ink is then transferred to an intermediate soft rubber material, which is sometimes referred to as a blanket, via different electrostatic forces. The ink is ultimately transferred to a substrate by contact with the substrate (not shown). The developer roller 120 has a main electrode 122 associated therewith that serve to electrically charge the ink 112. The main electrode 122 is sometimes referred as the first electrode. In the printing system 100 described herein, the ink 112 is negatively charged. Electric current, sometimes referred to as the first current, may be supplied to the main electrode 122 in order to charge the ink 112. The first current is measurable by the printing system 100 using conventional techniques. For example, an ammeter or the like may measure the first current.

The developer roller 120 rotates in a direction 124 as viewed from FIG. 1. As described in greater detail below, the rotation of the developer roller 120 and the electric field applied between developer roller 120 and the main electrode 122 enable ink 112 charged by the main electrode 122 to be applied to the developer roller 120. In addition, the rotation enables ink to be removed from the developer roller 120 and applied to the photo imaging plate 103 as described in greater detail below. It is again noted that the ink 112 present on the developer roller 120 is negatively charged.

Located proximate the developer roller 120 is a squeegee roller or squeegee electrode 128. The squeegee electrode 128 is sometimes referred to as the second electrode. The squeegee roller 128 serves to further negatively charge the ink 112. The current used to charge the squeegee electrode 128 is measurable by the printing device 100 using conventional means. This current is sometimes referred to as the second current. As described in greater detail below, this current is directly proportional to the charge applied to the ink 112 by the squeegee electrode 128.

The squeegee electrode 128 rotates in a direction 134 as viewed from FIG. 1. The direction 134 is opposite the direction 124. The rotation of the squeegee electrode 128 and the voltage applied to the squeegee electrode 128 enable the above-described charge to be applied to the to the ink under the squeegee electrode 128.

The photo imaging plate 103 moves in a direction 144 proximate the developer roller 120. In printing systems with several binary image developers, the photo imaging plate 103 moves proximate all the developer rollers. The ink 112 on the developer roller is transferred to the photo imaging plate 103 as the two move. This transfer of ink provides for a greater number of colors to be printed. The inks are ultimately transferred to a substrate, such as paper, which creates the printed image.

The thickness of the ink on the substrate may be measurable by the printing system 100 using conventional measuring techniques. In some embodiments, the thickness of the ink may be measured or interpreted by way of the optical density of the ink on the substrate, which may be measured using conventional techniques. In some embodiments, the optical density of the ink on the substrate is measured using an optical densitometer. As described below, the thickness of the ink is proportional to the optical density.

During the printing process, the developer electrode 122 charges the ink 112 by way of a first current received from the printing system 100. In the embodiments described herein, a negative charge is applied to the ink 112 via the developer electrode 122. As stated above, the first current is measured by the printing system 100. The ink 112 is applied to the developer roller 120. The ink 112 applied to the developer roller 120 reflects an image that is to be printed onto the substrate. The squeegee electrode 128 further charges the ink 112. In some embodiments, the ink 112 has the maximum charge after having passed proximate the squeegee electrode 128.

The ink 112 is retained on developer roller 120 per the above-described charges. As briefly described above, the ink 112 is applied to the developer roller 120 in locations where printing of the color of ink associated with the binary ink developer 102 is to occur. As the developer roller 120 rotates, the ink 112 moves proximate the photo imaging plate 103. At this point, the ink 112 can be transferred to the photo imaging plate 103. After the ink 112 has been transferred to the photo imaging plate 103, it is ultimately transferred or printed onto the substrate. As described above, the optical density of the ink 112 on the substrate can be measured by the printing system 100 using conventional techniques.

Having described the printing system 100, a method of determining the conductivity or high field conductivity of the ink 112 will now be described. The following description assumes that the substrate is paper. However, the substrate may be other printable materials.

In printing, such as binary image developing, the conductivity of the ink 105 affects the image quality. By knowing the conductivity of the ink 105, the printing processes can be modified to improve print quality. It has been determined that the conductivity of the ink 105 is proportional to the square of the sum of the first and second currents and inversely proportional to the square of the optical density of the ink on the paper. The conductivity of the ink 105 may be further proportional to the solid density of the ink 105 in the tank 104. The conductivity can also be determined as being equal to the product of a calibration factor, the solid density of the ink 105, and the square of the sum of the first and second currents, the product divided by the square of the optical density. The equation for high field conductivity is:

$$\sigma = C\frac{\delta_{res}(I_1 + I_2)^2}{OD^2_{Paper}} \quad \text{(Eq. 1)}$$

where:

σ is the high field conductivity;

$\sigma_{res}$ is the solid density of the ink 105 in the tank 104;

$I_1$ is the current of the main electrode;

$I_2$ is the current of the squeegee electrode; and

OD is the optical density of the paper.

Figure 2:
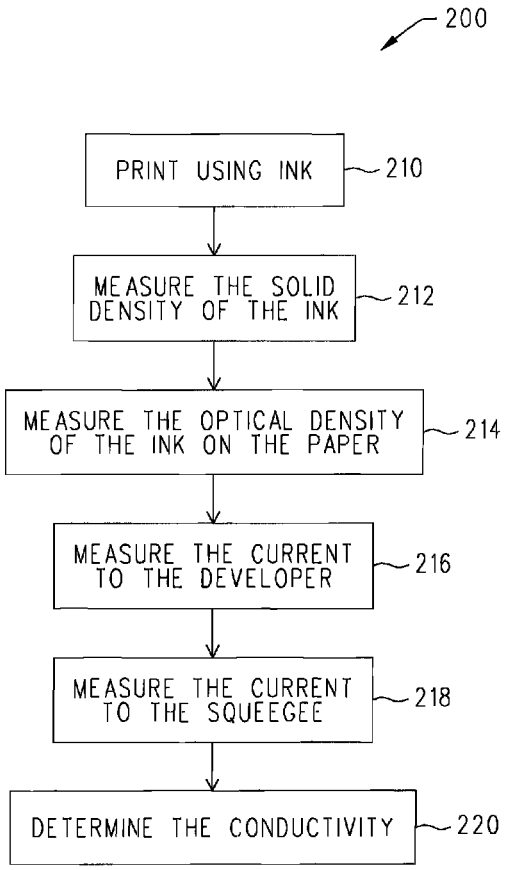
FIG. 2 is a flow chart describing an embodiment for determining the high filed conductivity of ink in the printing system of FIG. 1.

An embodiment of determining the conductivity or high field conductivity of the ink 105 is shown in the flowchart 200 of FIG. 2. The following methods may be performed by a computer or other machine by use of firmware, software, or other computer codes. In some embodiments, the printing system comprises or is associated with a computer having a computer-readable medium. The computer-readable medium includes code for instructing the computer to perform the methods described herein.

It is noted that the steps shown in the flowchart 200 do not necessarily need to be performed in the order shown. The method may start at step 210 with the printing system 100 printing on paper using the ink 112. At step 212, the solid density of the ink 105 in the tank 104 is measured. At step 214, the optical density of the printed paper is measured. This optical density is proportional to the thickness of the ink printed on the paper.

During the printing process, the currents to both the squeegee electrode 128 and the developer roller 120 are measured. More specifically, the current to the main electrode 122 is measured at step 216 and the current to the squeegee electrode 128 is measured at step 218. At this point, the conductivity can be determined using the currents, optical density, and solid density as described above (step 220).

In some embodiments, a calibration factor may be applied to the conductivity calculation. Accordingly, the conductivity may be further proportional to the calibration factor. In some embodiments, the thickness of the paper may be measured rather than the optical density of the paper. In such embodiments, the calibration factor may have to be changed.

In some embodiments, the actual conductivity is measured at the time of manufacture of the printing system 100 for various inks. The methods described herein are also applied to the inks to calculate the conductivities. The measured and calculated conductivities are then plotted and a line is passed through the points. The slope of the line is the calibration factor. In other words, the calibration factor may be the ratio of the calculated conductivity to the measured conductivity. The above-described equation (Eq. 1) for conductivity is derived as described below. Electrophoretic transport (F) of a charged particle through a viscous medium under the influence of an electric field (E) is given by the following equations:

$$F = ma = m\frac{dv}{dt} = QE - 6\pi\eta R_b v \quad \text{(Eq. 2)}$$

where:

Q is the particle charge;

E is the electric field in which the particle is under;

m is the mass of the particle;

η is the viscosity of the solution in which the particle is suspended;

v is the velocity of the particle; and $R_h$ is the hydrodynamic radius of the particle.

The solution for velocity (v), based on a hydrodynamic radius ($R_h$) less than two micrometers and steady state velocity being reached in less than twenty microseconds is as follows:

$$v = \frac{QE}{6\pi\eta R_b} \quad \text{(Eq. 3)}$$

In the steady state, a force balance exists between the electric field force (QE) and the Stokes drag force ($6\pi\eta R_h$). Therefore, the particle velocity (v) per unit electric field (E) is:

$$\mu = \frac{v}{E} = \frac{Q}{6\pi\eta R_b} \quad \text{(Eq. 4)}$$

Based on the foregoing, the particle velocity and mobility are functions of particle size, charge, and the viscosity. The electric current density is equal to the product of the number of charged particles (N), the charge per particle (Q), and the particle velocity (v). The current density is also the product of the conductivity and the electric field. Combining the equations 2-4 with the equation for conductivity (σ), conductivity can be expressed by the following equation:

$$\sigma = \frac{NQv}{E} = NQ\mu = \frac{NQ^2}{6\pi\eta R_b} \quad \text{(Eq. 5)}$$

The printing system 100 uses ink 105 in the tank 104 that has a very low concentration and is electrically neutral. The ink becomes highly compact and negatively charged on the developer roller 120, with the assistance of the squeegee electrode 128. The charge is applied via the first and second currents from the electrodes 122, 128. The sum of the currents is sometimes referred to as $I_{max}$, which is as follows:

$$I\max = N_{DR} \times (\text{DR width}) \times (\text{Ink height}) \times (\text{Process velocity}) \times (Q_{DR}) \quad \text{(Eq. 6)}$$

Where DR refers to the developer roller 120.

Assuming an equivalent spherical radius of each charged particle, the charge number density ($N_{DR}$) on the developer roller is:

$$N_{DR} = \frac{\delta_{DR}}{\frac{4}{3}\pi r_{eqh}^3} \quad \text{(Eq. 7)}$$

The ink height on the developer roller ($d_{DR}$) can be computed from the optical density measurement on paper by way of a known optical density to height conversion factor or direct measurement. An example of the conversion is as follows:

$$d_{DR} = K \cdot \mathrm{OD}_{paper} \quad \text{(Eq. 8)}$$

where: $\mathrm{OD}_{paper}$ is the optical density of the paper; and

K is a proportionality constant between the ink height and the optical density.

The solid density, $\delta_{DR}$, on the developer roller 120 may be between twenty-three and twenty-four percent.

When equations 6, 7, and 8 are combined, the charge ($Q_{DR}$) on the developer roller is expressed as follows:

$$Q_{DR} = \frac{\left(\frac{4}{3}\pi r_{heq}^3\right)(l_1 + l_2)}{vw\delta_{DR}K(OD_{paper})} \quad \text{(Eq. 9)}$$

where w is the width of the developer roller.

From the general expression of conductivity ($\sigma$), the conductivity of ink in the reservoir may be expressed as follows:

$$\sigma_{res} = \frac{N_{res}Q_{res}^2}{6\pi\eta_{res}R_h} \quad \text{(Eq. 10)}$$

It is noted that, for the conductivity determination, $Q_{res}$ is the same charge an ink particle will possess for operation at the developer roller. Therefore, $Q_{res}$ is equal to $Q_{DR}$ of equation 9.

All the terms above are constant, except the thickness of the ink on the paper. Therefore, the conductivity is written as:

$$\sigma_{res} = \frac{N_{res}Q_{DR}^2}{6\pi\eta_{res}r_{heq}^3} \quad \text{(Eq. 11)}$$

The particle density ($N_{res}$) in the ink reservoir can be written as:

$$N_{res} = \frac{\delta_{res}}{\frac{4}{3}\pi r_{eqh}^3} \quad \text{(Eq. 12)}$$

Therefore, substituting the particle density into equation 11 and using the charge ($Q_{DR}$) from equation 9, the conductivity of the ink in the reservoir ($\sigma_{res}$) is written as:

$$\sigma_{res} = (K)\frac{\delta_{res}(l_1 + l_2)^2}{d_{paper}^2} \quad \text{(Eq. 13)}$$

where K is a calibration constant. The optical density of the paper can be used instead of the ink thickness, which yields the conductivity as:

$$\sigma_{res} = (C)\frac{\delta_{res}(l_1 + l_2)^2}{OD_{paper}^2} \quad \text{(Eq. 14)}$$

where C is a calibration constant taking into account the use of the optical density verses the actual thickness of the paper. The calibration constant (C) accounts for differences between measured conductivity and the above-described calculated conductivity. The constant (C) may be derived by comparing the measured conductivity to the calculated conductivity, wherein the constant (C) is the ratio between the contuctivities.

As shown above, the high field conductivity of the ink in the reservoir ($\sigma_{res}$) can be determined using measured parameters in the printing system 100. By obtaining the conductivity or high field conductivity, the printing process can be modified to enhance the printing.

It is noted that other embodiments may exist. For example, the binary ink developer may not have the squeegee electrode 128. In this embodiment, the charge is proportional to the current to the main electrode 122. In some embodiments, the conductivity of the ink 112 is measured using the above-described techniques.

What is claimed is:

1. A method for measuring conductivity of ink in a printing system, said printing system comprising a developer roller, wherein said ink is formed on said developer roller using electrostatic forces, said method comprising:

printing on a substrate using said ink;

measuring a first current that charges said developer roller during said printing; and determining said conductivity of said ink, wherein said conductivity is proportional to a square of said first current.

2. The method of claim 1, further comprising measuring an ink thickness, wherein said conductivity is inversely proportional to the square of the ink thickness.

3. The method of claim 1, and further comprising measuring an optical density of said ink on said substrate; wherein said conductivity is inversely proportional to said optical density.

4. The method of claim 1, wherein said printing system further comprises a tank for storing said ink and a device for measuring a solid density of the ink in said tank, and wherein said method further comprises measuring the solid density of said ink in said tank, and wherein said conductivity is further proportional to said solid density of said ink in said tank.

5. The method of claim 1, wherein said conductivity is further proportional to a calibration factor.

6. The method of claim 1, wherein said printing system further comprises a squeegee electrode, and wherein said method further comprises measuring a second current to said squeegee electrode during said printing, said conductivity being proportional to the square of a sum of said first current and said second current.

7. The method of claim 1, wherein said developer roller has an electrode associated therewith and wherein said first current is supplied to said electrode.

8. A printing system comprising:

a developer roller having an electrode associated with said developer roller for applying a charge to said developer roller, wherein ink is formed on said developer roller using electrostatic forces, a computer-readable medium associated with said printing system for measuring a conductivity of said ink, said computer-readable medium comprising instructions for:

printing on a substrate using said ink;

measuring a first current to said electrode during said printing;

determining said conductivity of said ink, wherein said conductivity is proportional to a square of said first current.

9. The printing system of claim 8, further comprising a squeegee electrode, wherein said squeegee electrode further charges said ink by way of a second current and wherein the computer-readable medium further comprises instructions for applying said second current to said squeegee electrode and measuring said second current, and wherein said conductivity of said ink is proportional to the square of a sum of said first current and said second current.

10. The printing system of claim 8, wherein said printing system further comprises a reservoir for said ink and a device for measuring a solid density of the ink in said reservoir, and wherein the computer-readable medium further comprises instructions for measuring the solid density of said ink in said reservoir, and wherein said conductivity is further proportional to said solid density of said ink in said reservoir.

11. The printing system of claim 8, wherein said conductivity is further proportional to a calibrations factor.

12. The printing system of claim 8, wherein an optical density of the ink on said substrate is measurable by said printing system, and wherein the computer-readable medium further comprises instructions for measuring the optical density of said ink on said substrate; wherein said conductivity is inversely proportional to said optical density.

13. The printing system of claim 8, wherein said instructions further comprise measuring an ink thickness on said substrate, and wherein said conductivity is inversely proportional to said ink thickness.

14. A method for measuring a conductivity of ink in a printing system, said printing system comprising a developer roller and a squeegee electrode, wherein said ink is formed on said developer roller using electrostatic forces and said ink is further charged by said squeegee electrode, said method comprising:

printing on a substrate using said ink;

determining a thickness of said ink on said substrate;

measuring a first current to a first electrode that charges said developer roller during said printing;

measuring a second current to said squeegee electrode during said printing;

measuring a solid density of said link; and determining said conductivity of said ink, wherein said conductivity is proportional to a square of the sum of said first current and said second current, wherein said conductivity is proportional to said solid density of said ink, and wherein said conductivity is inversely proportional to the square of the ink thickness.

15. The method of claim 14, further comprising measuring an optical density of said ink on said substrate; wherein said ink thickness is proportional to said optical density.

* * * * *

UNITED STATES PATENT AND TRADEMARK OFFICE

CERTIFICATE OF CORRECTION

PATENT NO. : 8,774,682 B2
APPLICATION NO. : 12/995435
DATED : July 8, 2014
INVENTOR(S) : Manoj K Bhattacharyya It is certified that error appears in the above-identified patent and that said Letters Patent is hereby corrected as shown below:

In the Claims

In column 7, line 8, in Claim 8, delete “forces,” and insert -- forces; --, therefor.

In column 8, line 23, in Claim 14, delete “link;” and insert -- ink; --, therefor.

Signed and Sealed this
Fourth Day of November, 2014

Michelle K. Lee

Michelle K. Lee
*Deputy Director of the United States Patent and Trademark Office*